United States Patent [19]

Bone

[11] Patent Number: 4,572,702

[45] Date of Patent: Feb. 25, 1986

[54] EXPANSION JOINT

[76] Inventor: John M. Bone, 2534 Palo Pinto, Houston, Tex. 77080

[21] Appl. No.: 583,761

[22] Filed: Feb. 27, 1984

[51] Int. Cl.[4] ..... E01C 11/10

[52] U.S. Cl. ..... 404/65; 404/67; 404/69; 14/16.1; 52/396

[58] Field of Search ..... 14/16.1, 16.5; 404/48, 404/49, 64–69; 52/396; 49/475, 486; 277/205

[56] References Cited

U.S. PATENT DOCUMENTS

| | | | |
|---|---|---|---|
| 2,796,624 | 6/1957 | Speer | 52/470 |
| 3,363,383 | 1/1968 | La Barge | 52/471 |
| 3,520,236 | 7/1970 | Sequarius | 404/69 |
| 3,595,142 | 7/1971 | Via | 404/49 |
| 3,606,826 | 9/1971 | Bowman | 404/49 |
| 4,007,994 | 2/1977 | Brown | 404/69 |
| 4,063,839 | 12/1977 | Brown | 404/69 |
| 4,067,155 | 1/1978 | Ruff et al. | 52/105 |
| 4,129,967 | 12/1978 | Barlow | 404/69 |
| 4,285,612 | 8/1981 | Betti | 404/68 |
| 4,339,214 | 7/1982 | Puccio et al. | 404/69 |
| 4,374,442 | 2/1983 | Hein et al. | 404/69 |
| 4,378,176 | 3/1983 | Puccio | 404/69 |

FOREIGN PATENT DOCUMENTS

| | | | |
|---|---|---|---|
| 2549041 | 5/1977 | Fed. Rep. of Germany | 404/69 |

*Primary Examiner*—James A. Leppink
*Assistant Examiner*—John F. Letchford
*Attorney, Agent, or Firm*—Dodge, Bush & Moseley

[57] ABSTRACT

An expansion joint adapted for sealing an elongated gap formed between two adjacent road sections. The joint provides a continuous support for vehicles crossing the gap while enabling the desired temperature responsive movement of the slab road sections. A pair of non-metallic elongated mounting strips are secured to the adjacent road sections on either side of the gap. An elongated seal strip is mechanically and adhesively secured between the spaced mounting strips for straddling the gap to exclude entry of undesired matter into the gap. A curable epoxy cement is employed to form a smooth transition vehicle support surface between the road sections and the seal strip.

1 Claim, 3 Drawing Figures

EXPANSION JOINT

BACKGROUND OF THE INVENTION

1. Technical Field

This invention relates generally to the field of sealing thermal expansion gaps between adjacent monolothic structures and specifically to expansion joints for sealing expansion gaps of roadways, bridge decks, parking garages and the like.

2. Background Art

U.S. Pat. No. 3,363,383 to La Barge discloses an expansion joint structure for sealing vertical seams between adjacent building panels rather than for tire contacting bridge or highway service. The combined securing and sealing member is resiliently deformed for securing in the mounting recess which is normally adequate for the intended static structural use or service.

U.S. Pat. No. 2,796,624 to Speer discloses an expansion joint for use with a linoleum floor covering while U.S. Pat. No. 4,067,155 to Ruff, et al. discloses a thermal and moisture resistant seal for gaps between structural building panels. The seal of the latter patent employs both interfitting resilient teeth and an adhesive-sealant that seals the secured cap to the adjoining panels.

Brown U.S. Pat. No. 4,007,994 is entitled "Expansion Joint With Elastomer Seal" and discloses a V-shaped elastomer seal of neoprene formulation is secured by resilient elongated tongue and groove means which are deformingly received in recesses formed in the extruded aluminum longitudinal side frames. The Brown expansion joint is intended for use on pavements and bridge decks as is a similar joint disclosed in companion Brown U.S. Pat. No. 4,063,839.

U.S. Pat. No. 3,606,826 to Bowman discloses an expansion joint having a unitary tubular resilient sealing member having an internal truss structure which mechanically interlocks with the two parallel support frame members to minimize tensile strain on the adhesive bonding. The expansible and contractable seal may be employed in either a single or double mounting depending on the width of the gap. In the double mounting, a metal wear tread member is secured to the floating central connecting member for bridging the gap to protect the seal.

U.S. Pat. No. 3,595,142 to Via is entitled "Expansion Rubber Joint For Roads And Bridges". The disclosed expansion joint seal strip is provided with two parallel beads each having a half dove-tail fit for mechanically securing in complementary grooves in the adjacent sections. Resilient wedge members secure the elongated seal in each of the grooves or channels to prevent puckering of the seal edges when under tire traction.

Sequarius U.S. Pat. No. 3,520,236 is entitled "Means For Covering And Rendering Waterproof Expansion Joints For Road, Bridges And Other Civil Engineering Constructions". The disclosed seal employs an elastic strip secured in position by suitable bolting. The Leavy elastomer seal mounts a metal stiffener or reinforcing plate which slides on a metal support plate that bridges the gap to support the seal.

U.S. Pat. No. 4,285,612 to Betti utilizes an epoxy mortar to cast shoulders of the concrete joint adjacent the gap for strengthening the edges of the concrete panels. The gap or socket formed between the shoulder receives a hollow resilient sealing element which is secured by an adhesive to the shoulders. The hollow core of the element is then filled with a pressurized liquid filler material that hardens or sets after the adhesive bonds the sealing element to both shoulders.

In Puccio U.S. Pat. No. 4,378,176 snow plow deflectors are provided for the resilient roadway expansion joint seal which is secured by recessed bolted clamps. In Puccio et al U.S. Pat. No. 4,339,214 the resilient seal is strengthened by the use of intermediate metal reinforcing inserts which laterally slide on a support beam and form the vehicle support surface.

The Barlow U.S. Pat. No. 4,129,967 expansion joint seal employs a tongue and groove securing arrangement that requires a slidable bridging plate for protecting the resilient seal element. The seal employs a tongue and groove arrangement that merely holds the protected seal.

The Hein et al U.S. Pat. No. 4,374,442 disclosed expansion joint requires an expensive and difficult to install convolution structure.

As described in the above identified prior art patents, which are hereby incorporated by this reference in full for any in all purpose as if fully set forth herein, the requirements of an expansion joint for service on roadway bridge decks, highways and the like are significantly more demanding than the requirements for simply sealing between essentially static structural panels and which are not subjected to the traction loading of tires in engagement with the expansion joint.

In general, the essentially static expansion joint seals not subjected to traction loading need only compensate in change of dimensions of the gap resulting from thermal variations. In such instances, it is relatively simple to use soft and resilient seal strips which may be received within securing channels on either side of the gap to be sealed. The resilient nature of the material coupled with the joint design are normally more than adequate to compensate for the thermal change in gap dimensions.

Roadway expansion joint seals must be either protected from the vehicular traffic or made sufficiently strong to resist, or withstand such loading. The corrosive effects of salt severly reduces the useful life of expansion joints employing metal protective shields or supports. In addition, the sliding arrangement of the metal components may also lead to premature failure in the event of binding. Employment of metal components in the expansion joint requires increased engineering planning and design, extensive preliminary fabrication efforts and a much heavier expansion joint which requires heavy equipment to handle and install.

SUMMARY OF THE INVENTION

The present invention relates to a light weight expansion joint for protection of thermal expansion gaps formed on roadways, bridge decks and the like while providing a substantially smooth continuous support surface for vehicles travelling over the expansion joint. Non-metallic mounting strips are secured to the roadway sections on each side of the elongated gap in a predetermined spaced parallel relationship with suitable securing means such as spaced bolting. Each mounting strip base is formed with an upwardly projecting securing ridge having a locking surface mounted thereon facing away from the gap. A resiliently deformable seal strip is secured to the mounting strips by engagement of an interior surfaces of the parallel flanges with the locking surface on each of the mounting strips. The locking surfaces are provided with tongue and groove arrangement for interengaging with a complementary tongue and groove surface formed on the downwardly extending flanges of the seal strip which are connected by a central web. The outer surfaces of the flanges are also provided with a tongue and groove arrangement for receiving a hardening filler material such as an epoxy cement to prevent mechanical disengagement from the mounting strips while the adhesive placed upon the interengaged tongue and grooves secure the flanges to the mounting strips. The combination of the adhesive binding with the mechanical locking of the mounting strips and the seal strip provides superior strength against puckering or pull out of the resilient seal strip without the use of metal protective plates which are subject to corrosion. The joint may be easily and rapidly installed with hand tools and with a minimum of engineering design.

DESCRIPTION OF THE PREFERRED EMBODIMENT

Figure 1:
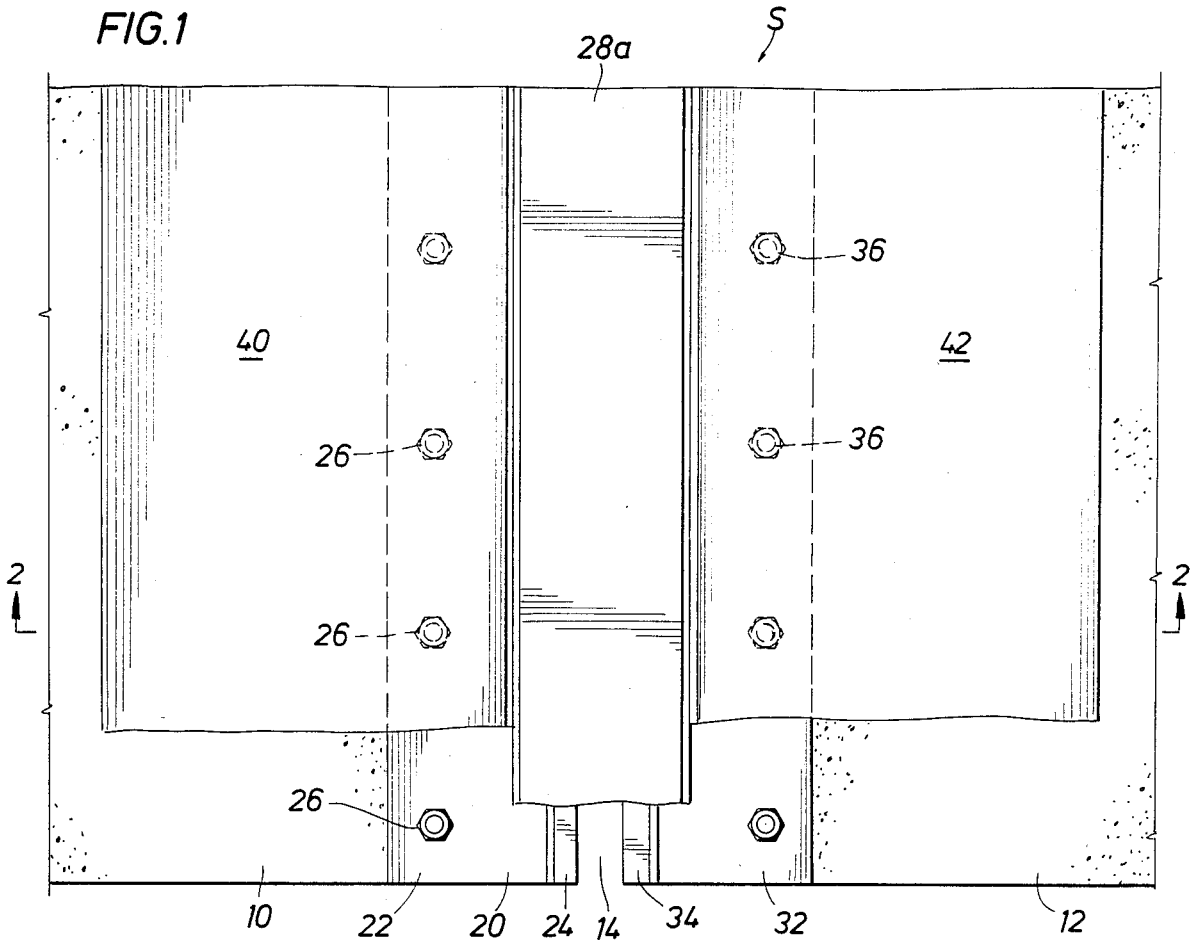
FIG. 1 is a vertical or top view, partially cut away, illustrating the longitudinally extending expansion joint of the present invention.

The expansion joint apparatus or assembly, generally designated S, of the present invention is illustrated in two embodiments in the Figs. Both embodiments are useful for sealing or protecting thermal expansion gaps formed on road sections such as highways, bridge decks, vehicle parking garages and the like.

Thermal expansion compensation is necessary in reinforced concreted structures to allow for the expansion and contraction between the adjacent road panels or sections 10 and 12. The longitudinal gap 14 formed between the sections 10 and 12 provides the movement or growth enabling clearance resulting from thermal changes. However, it is necessary to protect the gap 14 from having undesired foreign material enter or lodged therein which could render the gap 14 inoperative or in the case of parking garages and the like, enable water to seep between floors. The expansion joint assembly J of the present invention accomplishes the desired results while providing a substantially continuous support surface for the wheels or vehicle tires (not illustrated) as they roll across the gap 14 between the road support sections 10 and 12.

The expansion joint apparatus S includes a first mounting strip 20 that is secured to the road section 10 adjacent the elongated gap 14. The first mounting strip 20 is formed by a flange or base 22 adjacent the section 10 and an upwardly projecting securing ridge 24. The base 22 is provided with suitable means for securing the first mounting strip 20 with the road section 10 such as by anchor bolting openings **22*a* which are formed along the base 22 at suitable longitudinally spaced locations. Securing bolts 26 embedded in the road section 10 in the conventional or usual manner, extend through the openings 22*a* for securing the base 22 with the road section 10 in the usual manner. As the mounting strip 20 is preferably formed of a non-metallic material the openings 22*a* may be easily formed in the field with hand tools to assure proper mating with bolts 26**.

Figure 2:
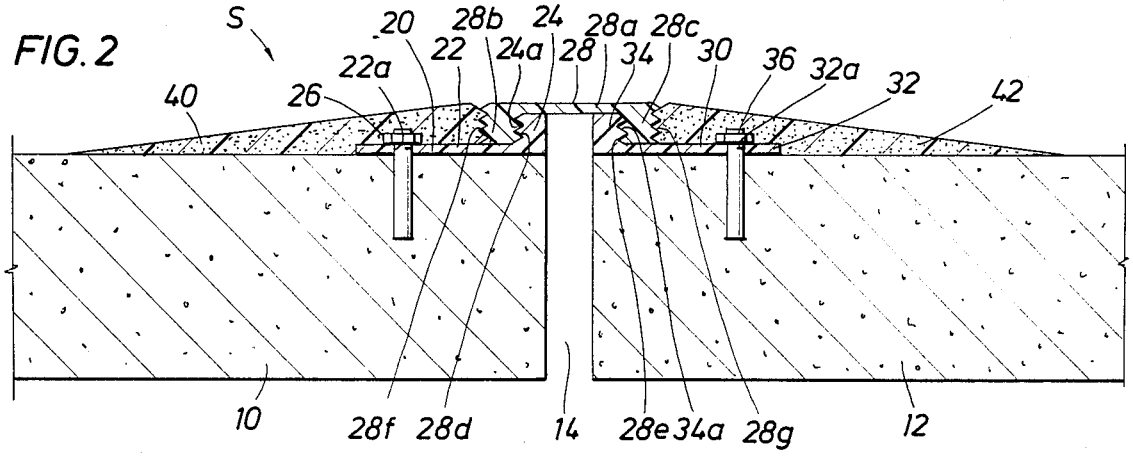
FIG. 2 is a cross-sectional side view taken along lines 2—2 of FIG. 1.

As illustrated in FIG. 2, the securing ridge 24 is preferably positioned at the edge of the road section 10 forming the gap 14 with a securing surface or locking face 24 located away from the gap 14. The securing surface **24*a* is provided with a suitable longitudinally extending tongue and groove arrangement, such as the saw tooth profile illustrated for mechanically connecting with a seal strip 28** in a manner to be more fully described hereinafter.

Mounted with the road section 12 adjacent the gap 14 is a second mounting strip 30 that is preferably identical in construction to the first seal strip 20 but secured with the road section 12 facing in the opposite direction. As the construction of the seal strip 30 is identical to the seal strip 20, the identical reference characters, increased by a factor of ten are used to indicate like parts of the seal strip 30. Thus, the openings for the bolts 36 are provided by openings **32*a* formed in the base 32. Locking face 34*a* performs the same function as the locking face 24*a* of mechanically locking with the seal strip 28** in the manner illustrated, it being understood that the saw tooth construction illustrated employs a complementary triangular cross-sectional thread crest and root construction, but any interfitting tongue and groove type construction may be used.

The seal strip 28 seals between the securing ridges 24 and 34 to block passage of undesired material such as water, dirt and the like to prevent leakage through or closing of the gap 14. The seal strip 28 is formed by a central web **28*a* which straddles the gap 14 and connects a pair of downwardly facing parallel attachment ribs 28*b* and 28*c*. Each of the attachment ribs 28*b* and 28*c* have an interior surface 28*d* and 28*e*, respectively, facing towards each other and the gap 14 for sealing with the mounting strips 20 and 30. The interior facing surfaces 28*d* and 28*e* are provided with complementary tongue and groove arrangements for engaging the locking surfaces 24*a* and 34*a* of the mounting strips 20 and 30. Each of the attachment ribs 28*b* and 28*c* have an exterior surface 28*f* and 28*g*, respectively, facing away from the gap 14. The surfaces 28*f* and 28*g*** are also provided with a tongue and groove arrangement.

To protect vehicle tires and provide a smooth continuous roadway from the road sections 10 and 12 to the upper web **28*a*, suitable transition or nosing is provided by a body 40 and 42 of a castable epoxy cement. The epoxy cement 40 and 42 provids a superior strength to withstand the impact and wear of the vehicle tires coupled with the ability to be field shaped or formed for ease of installation. The epoxy cement also interlocks with the tongue and grooves on the outwardly facing surfaces 28*f* and 28G to lock the seal strip 28 with the mounting strips 20 and 30. The epoxy mortar in its plastic form is used to fill such spaces for effecting the tongue and groove mechanical interlock with the seal strip 28 as well as achieving some adhesive bond. As best illustrated in FIG. 2, the cement bodies 40 and 42 are feathered or tapered upwardly to the web 28*a* to provide the substantially smooth and continuous ramp to the web 28*a* of the expansion joints which bridges the gap 14. This provides the continuous surface to avoid pounding to the tires or the road sections 10 and 12. The tapered embodiment illustrated in FIG. 2** is particularly desirable in forming a speed bump for limiting the speed at which vehicular traffic may pass over the expansion joint. This arrangement is frequently chosen for use in parking garages or roadways where high speed vehicle travel is undesirable.

Figure 3:
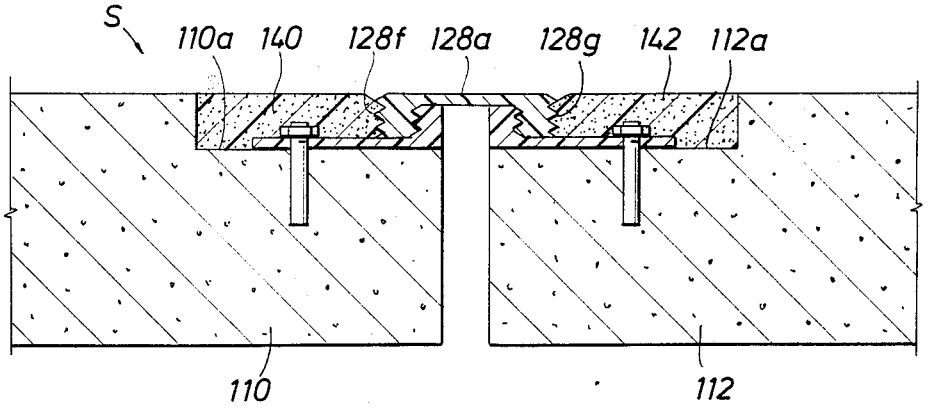
FIG. 3 is a view similar to FIG. 2 illustrating another form of the present invention.

An alternate embodiment is illustrated in FIG. 3 which provides a flush expansion joint S also built in accordance with the present invention, but which enables high speed vehicle passage. In this embodiment, identical reference characters, increased by a factor of 100, are employed for identifying identical parts of the expansion joint S. The significant difference between the embodiment in FIG. 3 and FIG. 2 being that the road sections 110 and 112 are formed with recesses 110*a* and 112*a* into which the expansion joint assembly S is placed. In this embodiment, the bodies 140 and 142 of epoxy cement that are cast in place are shaped to provide a substantially flush construction in order that the web 128*a* and the epoxy cement 140 and 142 are substantially level with the support or roadway deck formed by the sections 110 and 112. In both embodiments the bodies of cast epoxy cement protect the securing bolts from contact with the corrosive volts for enhancing the useful life of the joint S.

To avoid many of the problems previously encountered in installing a durable expansion joint, the corrosive resistant materials of constructions used in the expansion joint S of the present invention may be quickly and easily worked in the field using hand tools. The mounting strips 20 and 30 are preferably formed from a longitudinally extruded plastic material sold by BF Goodrich Company of Cleveland, Ohio under the trademark "GEON" vinyls and which may be field drilled to provide the longitudinally spaced openings for the securing bolts 26 and 36. The seal strip is preferably fabricated from a material provided by Teknor Apex Co. of Pawtucket, Rhode Island under the designation "TELCAR-No. 81-D954A". The "TELCAR" material may be fabricated to desired shapes by either Atlantis Plastics Co., 5705 Hogue, Houston, Tex. or Shepler Equipment Company, Inc., 9103 East Almeda Road, Houston, Tex. The strip seal 28 is adhesively bonded to the mounting strips by a suitable epoxy adhesive such as that sold by Sika Chemical Co., Lindhurst, N.J., under the designation "Sikadur Hi-Mod Gel".

While any high strength concrete may be employed to provide the filler or ramps 40 and 42, one suitable material has been found to be an epoxy concrete batched with aggregate composed of ninety-five (95) percent clemtex No. 2 and five (5) percent Clemtex No. 5 commercially available from Clemtex, Ltd, 248 McCarty, Houston, Tex. The epoxy cement is manufactured by I. W. Industries, 6119 Westview, Houston, Tex. and sold by Shepler's under the designation of "Shepox 140".

Since the materials construction are substantially all plastic and relatively lightweight as well as being easily worked by hand tools, the expansion joints S of the present invention are easily installed by workmen without the need for heavy equipment and the like nor are they susceptible to corrosion damage from salt exposure.

USE AND OPERATION OF THE PRESENT INVENTION

In the use and operation of the present invention, the mounting strip 20 is first installed in the manner illustrated. After positioning the strip 20 adjacent the gap 14 in the desired manner, the bolting 26 is employed to hold the strip 20 in position adjacent the gap 14. Depending upon the temperature range being designed for, the mounting strip 30 is then installed. The dimension or distance between the locking surfaces 24*a* and 34*a* of the mounting strips 20 and 30 is determined or calculated by the exposed temperature range and which is the only engineering calculation required. When properly positioned at the predetermined dimension, the securing holes 32*a* may be drilled and the securing bolts 36 installed to hold the mounting strips 30 in a substantially parallel position to the strip 20, but spaced apart this calculated desired distance.

Locking surfaces 24*a* and 34*a* are then coated with a suitable adhesive such as the "Sikadur Hi-Mod Gel". The adhesive is also applied to the interior faces 28*d* and 28*e* of the seal strip 28*a* which is then snapped into place. The epoxy cement is then mixed to form bodies 40 and 42 and while still in the plastic state, positioned and formed in the desired condition of either FIG. 2 or 3 where they are allowed to cure at the same time the adhesive bond between the seal strip 28 and the mounting strips 20 and 30 is curing. When suitably cured the expansion joint S may be put into service where it functions to preclude undesired matter from entering the gap 14.

The foregoing disclosure and description of the invention are illustrative and explanatory thereof, and varoius changes in the size, shape and materials, as well as in the details of the illustrated construction, may be made without departing from the spirit of the invention.

What is claimed is:

1. An expansion joint adapted for sealing an elongated gap formed between two adjacent road sections while providing a continuous support for the vehicle tires, including:

a first non-metallic mounting strip mountable with one of the road sections adjacent the elongated gap said first mounting strip having a base with a securing ridge formed thereon, said securing ridge forming a locking surface facing away from the gap;

a means with said first mounting strip for securing said first mounting strip to the one road section at a desired location adjacent the gap and extending substantially the length of the gap;

a second non-metallic mounting strip mountable with the other of the two road sections adjacent said elongated gap, said second mounting strip having a base with a securing ridge formed thereon, said securing ridge of said second mounting strip forming a locking surface facing away from the gap;

means with said second mounting strip for securing said second mounting strip to the other of the two road sections adjacent said elongated gap at a predetermined distance from said first mounting strip and extending substantially the length of the gap; and a seal strip secured to said first mounting strip and said second mounting strip for sealing between said first and said second mounting strip to block passage of undesired matter into the gap, said seal strip adhesively bonded to each of said mounting strips along substantially the entire length of said seal strip, said seal strip having a central web connecting a pair of parallel attachment ribs, each said attachment rib having an interior surface facing toward said other attachment rib and an exterior surface facing away from said attachment rib, said first locking surface of said first mounting strip and one of said interior surface on said seal strip having interengageable locking projections and grooves for mechanically locking said seal strip with said first mounting strip; and said second locking surface of said second mounting strip and one of said interior surface on said seal strip having interengageable locking projections and grooves for mechanically locking said seal strip with said second mounting strip;

said exterior surface of said attachment rib having a plurality of projections and grooves formed thereon; and a body of epoxy mortar cast adjacent said exterior surface of said rib for preventing disengagement of the interior surface of said attachment rib and for providing a continuous transition roadway from the road section to said seal strip for the vehicle tires.

* * * * *